United States Patent [19]

Kuokkanen

[11] Patent Number: 5,047,739

[45] Date of Patent: Sep. 10, 1991

[54] TRANSMISSION LINE RESONATOR

[75] Inventor: Lauri Kuokkanen, Kempele, Finland

[73] Assignee: LK-Products Oy, Kempele, Finland

[21] Appl. No.: 377,854

[22] PCT Filed: Oct. 7, 1988

[86] PCT No.: PCT/FI88/00163

§ 371 Date: Jun. 12, 1990

§ 102(e) Date: Jun. 12, 1990

[87] PCT Pub. No.: WO89/05046

PCT Pub. Date: Jun. 1, 1989

[30] Foreign Application Priority Data

Nov. 20, 1987 [FI] Finland ..... 875142

[51] Int. Cl.[5] ..... H01P 7/00; H01P 1/20

[52] U.S. Cl. ..... 333/219; 333/202

[58] Field of Search ..... 333/202, 204, 205, 207, 333/206, 219, 222, 223, 224, 235, 246, 177; 336/199, 200, 205, 208

[56] References Cited

U.S. PATENT DOCUMENTS

| | | | |
|---|---|---|---|
| 3,247,475 | 4/1966 | Buetow et al. | 333/224 X |
| 3,691,487 | 9/1972 | Yoshimoto | 333/202 |
| 4,342,969 | 8/1982 | Myers et al. | 333/219 X |
| 4,621,245 | 11/1986 | Dobrovolny et al. | 333/202 |
| 4,682,131 | 7/1987 | May | 333/202 |
| 4,700,158 | 10/1987 | Dorsey | 333/202 |

FOREIGN PATENT DOCUMENTS

| | | | |
|---|---|---|---|
| 0024201 | 2/1983 | Japan | 333/219 |
| 1532895 | 11/1978 | United Kingdom . | |

OTHER PUBLICATIONS

Patent Abstracts of Japan, vol. 9; No. 302(E-362), abstract of JP 60-140901, published 1985-07-25.

Patent Abstracts of Japan, vol. 9; No. 169(E-328), abstract of JP 60-42902, published 1985-03-07.

*Primary Examiner*—Eugene R. LaRoche

*Assistant Examiner*—Seung Ham

*Attorney, Agent, or Firm*—Bell, Seltzer, Park & Gibson

[57] ABSTRACT

The invention relates to a resonator structure comprising a helix resonator (1) wound of metal wire into a cylindrical coil and supported by a plate (2) of insulating material disposed therewithin. A helix resonator is usually made in the form of a cylindrical coil and supported by disposing within the coil a frame made of a ceramic material or plastic in various ways. This is necessary for providing a sufficient mechanical strength. However, such a structure is difficult and expensive to manufacture in series production especially with smaller resonator sizes. These problems are solved by means of a resonator according to the invention in such a manner that at least a part of the insulating plate (2) comprises an electrical circuit formed by strip lines (3), and that the helix resonator (1) is electrically connected to said circuit.

6 Claims, 1 Drawing Sheet

TRANSMISSION LINE RESONATOR

The invention relates to a resonator structure comprising a helix resonator wound of metal wire into a cylindrical coil and supported by a plate of insulating material disposed therewithin.

Various coils and capacitors are used widely as basic structural parts in electrotechnical filters With frequencies of the order of hundred megahertz, losses begin to grow as well as side effects caused particularly by the structure of capacitors. The series inductance of a capacitor is no longer an insignificant matter nor is the stray capacitance between the coil turns relative to the surroundings. Up to a certain limit, such problems can be reduced by capacitor and coil structures. However, with increased frequencies the losses of coils and capacitors increase in the end to such an extent that various transmission line and cavity resonators are the only alternative as far as losses are concerned.

Having small losses, coaxial resonators are the most widely used especially with great powers. The losses decrease with increasing resonator size and simultaneously the power resistance is improved. At frequencies up to about 10 to 15 GHz, strip and microstrip techniques are used widely.

Within the frequency range from 100 to 1000 MHz, both coaxial and strip line resonators are often unnecessarily large as well as expensive. Within this frequency range, so called helix resonators are in general use. The structure of helix resonators differs from that of coaxial resonators in that the middle wire is wound into a coil. The specific impedance of a helix resonator is mainly determined by the ratio of the diameter of the coil to the inner dimension of the outer shell and the pitch of the coil. Within the frequency range from 100 to 1000 MHz and the Q value range from 500 to 1000, the size of a helix resonator is about one third of that of a coaxial resonator with similar properties. The helix resonator is usually made in the form of a cylindrical coil and supported by disposing within the coil a frame manufactured of a ceramic or plastic material in various ways. This is necessary for achieving a sufficient mechanical strength. However, the structure is thus difficult and expensive to manufacture in series production, especially with small resonator sizes.

In portable radio devices in particular, small-size resonators with small losses are of vital importance as structural parts in various high-frequency filters. When the size has become smaller, it has become increasingly difficult to at all attain a sufficient manufacturing accuracy in the production of such filter structures even though expensive solutions were used.

The object of the present invention is to provide a resonator structure which is well suited for series production due to its easy and inexpensive manufacture and which, however, combines the advantages of a good volume/loss ratio of a helix resonator and a simple small-loss support structure. This is achieved by means of a resonator structure of the type described at the beginning in such a way that at least part of the insulating plate comprises an electrical circuit formed by strip lines, and that the helix resonator is connected electrically to said circuit.

The basic idea of the invention is thus to integrate a discrete helix resonator in a strip line structure in such a way that the insulating plate on the surface of which the strip line structure is formed functions simultaneously as a support for the helix resonator.

In the structure according to the invention a good reproducibility and mechanical simplicity are obtained, which improves the productive capacity and reduces costs. Circuit technical solutions which have not been used previously on account of problems of reproduction are now possible, which improves the efficiency of the products.

According to a preferred embodiment of the invention, the housing surrounding the resonators is formed by two halves made of metal or coated with metal so as to be electrically conductive. The halves are positioned against one another and interconnected in an electrically conductive manner. The insulating plate is supported on recesses formed in the edges of the housing halves. In this way a structure is provided which is simple and steady.

The invention will be described in more detail in the following with reference to the example of the attached drawings, wherein FIG. 1 is a front view of a resonator structure according to the invention without a housing;

Figure 1:
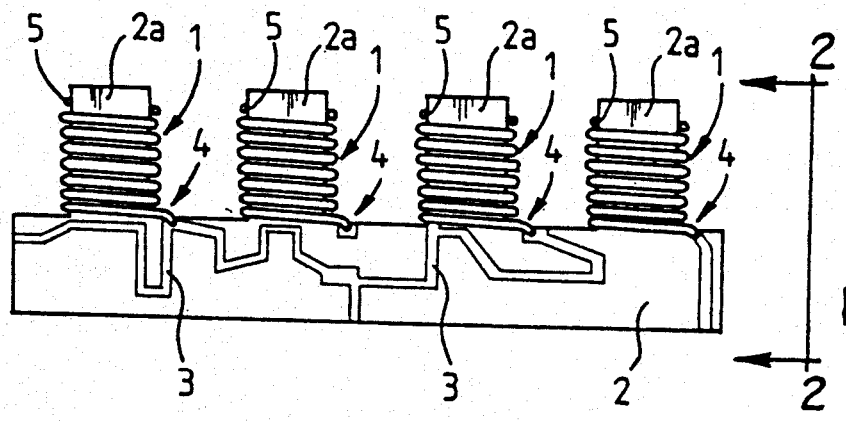
Figure 2:
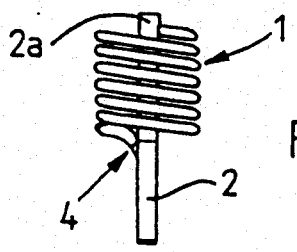
FIG. 2 illustrates the structure of FIG. 1 seen in the direction A—A.

The resonator structure shown in FIGS. 1 and 2 comprises four discrete helix resonators 1 wound of metal wire into cylindrical coils. Each resonator is arranged around projections 2*a* formed in a plate 2 made of an insulating material. The bottom part of the insulating plate 2 is provided with an electric circuit formed by strip lines 3, to which circuit the resonators are connected in an electrically conductive manner (e.g. by soldering) at points indicated with the reference numerals 4. Each resonator 1 is further connected mechanically to the projection 2*a* by soldering to a metallized point on the projection. These mechanical connection points are indicated with the reference numeral 5 in FIG. 1.

Figure 3:
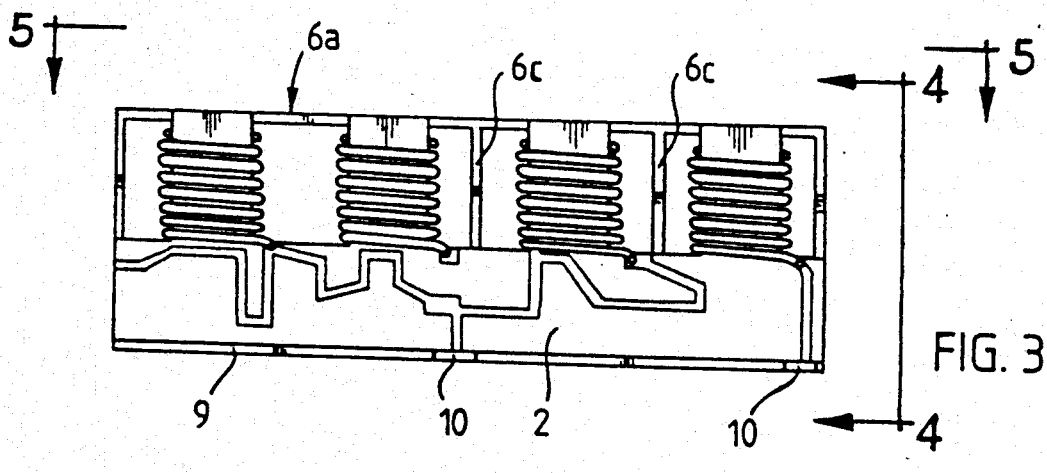
FIG. 3 illustrates the structure of FIG. 1 when positioned in one housing half.
Figure 4:
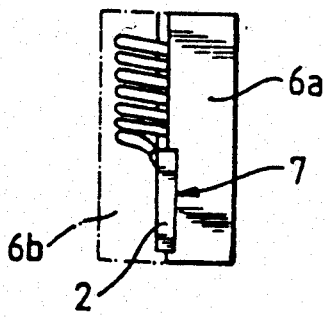
FIG. 4 illustrates the structure of FIG. 3 seen in the direction B—B.
Figure 5:
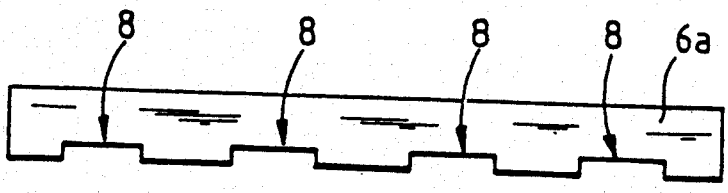
FIG. 5 is a top view of one housing half, seen in the direction C—C of FIG. 3.

In FIG. 3, the insulating plate 2 with its helix resonators is positioned in one housing half 6*a*. The housing is formed by two halves 6*a* and 6*b* positioned against each other. The latter half is indicated with broken lines in FIG. 4. The housing halves are interconnected in an electrically conductive manner. Recesses for the insulating plate are provided in each housing half 6*a* and 6b. The ends of the housing halves and parting walls 6*c* between the resonators comprise recesses 7 (FIG. 4) for the bottom part of the insulating plate, and the top portion of the housing halves comprises recesses 8 for the end portion of the projections 2*a*. Each recess corresponds in depth to half the thickness of the insulating plate 2. In addition, the bottom 9 of the housing halves (FIG. 3) is provided with outlets 10 for connections to external circuits.

Even though the invention has been described above with reference to the example of the attached drawing, it is obvious that the invention is not restricted thereto but it can be modified in various ways within the inventive idea disclosed in the attached claims. Accordingly, the number of the helix resonators, for instance, may vary as well as the dimensions of the different parts.

Also, one or more structures according to the invention can be assembled into a filter for high-frequency electric signals.

I claim:

1. A resonator structure comprising a helix resonator (1) wound of metal wire into a cylindrical coil and supported by a plate (2) of insulating material disposed therewithin, characterized in that at least a part of the insulating plate (2) comprises an electrical circuit formed by strip lines (3), and that the helix resonator (1) is electrically connected to said circuit.

2. A resonator structure according to claim 1, comprising a plurality of helix resonators (1), characterized in that the insulating plate (2) is provided with a projection (2*a*) for each resonator (1).

3. A resonator structure according to claim 2, characterized in that each helix resonator (1) is mechanically connected at the top portion (5) thereof to the insulating plate (2).

4. A resonator structure according to any of the preceding claims, characterized in that the resonators are surrounded with a housing formed by two halves (6*a*, 6*b*) positioned against each other, whereby the halves, made of metal or coated with metal so as to be electrically conductive, are interconnected in an electrically conductive manner.

5. A resonator structure according to claim 4, characterized in that the insulating plate (2) is supported on recesses (7, 8) formed in the edges of the housing halves (6*a*, 6*b*), and that, strip lines (3) on the insulating plate (2) are at these points connected to the housing in an electrically conductive manner.

6. A resonator structure according to claim 2, characterized in that the resonators (1) are connected by means of the strip lines (3) by at least one of a direct electrical connection, an electric field coupling, and a magnetic field coupling to each other and further to external electrical circuits.

* * * * *